US005564475A

United States Patent [19]

Wright

[11] Patent Number: 5,564,475

[45] Date of Patent: Oct. 15, 1996

[54] TWO-PLY FORMING FABRIC WITH THREE OR MORE TIMES AS MANY CMD YARNS IN THE TOP PLY THAN IN THE BOTTOM PLY

[75] Inventor: Walter P. Wright, Larsen, Wis.

[73] Assignee: Asten, Inc., Charleston, S.C.

[21] Appl. No.: 455,135

[22] Filed: May 31, 1995

Related U.S. Application Data

[63] Continuation of Ser. No. 134,537, Oct. 8, 1993, Pat. No. 5,421,374.

[51] Int. Cl.[6] ..... D03D 11/00; D03D 13/00

[52] U.S. Cl. ..... 139/383 A

[58] Field of Search ..... 139/383 A, 425 A

[56] References Cited

U.S. PATENT DOCUMENTS

| | | | |
|---|---|---|---|
| 4,171,009 | 10/1979 | Karm . | |
| 4,314,589 | 2/1982 | Buchanan et al. . | |
| 4,361,618 | 11/1982 | Dufour et al. . | |
| 4,423,755 | 1/1984 | Thompson . | |
| 4,499,927 | 2/1985 | Borel . | |
| 4,500,588 | 2/1985 | Lundström . | |
| 4,501,303 | 2/1985 | Österberg . | |
| 4,518,644 | 5/1985 | Vuorio . | |
| 4,554,953 | 11/1985 | Borel et al. . | |
| 4,564,051 | 1/1986 | Odenthal . | |
| 4,564,052 | 1/1986 | Borel . | |
| 4,569,375 | 2/1986 | Borel | 139/383 |
| 4,569,883 | 2/1986 | Renjilian | 428/234 |
| 4,592,395 | 6/1986 | Borel | 139/383 |
| 4,605,585 | 8/1986 | Johansson | 428/224 |
| 4,709,732 | 12/1987 | Kinnunen | 139/383 |
| 4,739,803 | 4/1988 | Borel | 139/383 |
| 4,776,373 | 11/1988 | Borel | 139/383 |
| 4,867,206 | 9/1989 | Kufferath | 139/383 |
| 4,945,952 | 8/1990 | Vöhringer | 139/383 |
| 4,967,805 | 11/1990 | Chiu et al. | 139/383 |
| 5,025,839 | 6/1991 | Wright | 139/383 |
| 5,421,374 | 6/1995 | Wright | 139/383 A |

*Primary Examiner*—Andy Falik
*Attorney, Agent, or Firm*—Volpe and Koenig, P.C.

[57] ABSTRACT

A papermakers forming fabric having two layers of CMD yarns interwoven with a system of MD yarns to form a multilayer fabric. The paper support surface CMD yarn layer has at least three times as many CMD yarns as the machine contact surface CMD yarn layer. The higher count of upper layer CMD yarns provides an improved paper forming/carrying surface with improved drainage characteristics.

5 Claims, 6 Drawing Sheets

TWO-PLY FORMING FABRIC WITH THREE OR MORE TIMES AS MANY CMD YARNS IN THE TOP PLY THAN IN THE BOTTOM PLY

This is a continuation of application Ser. No. 08/134,537, filed on Oct. 8, 1993. U.S. Pat. No. 5,421,374.

BACKGROUND OF THE INVENTION

1. Field of the Invention

The present invention relates to papermakers fabrics. More particularly, the present invention relates to forming fabrics which are used to facilitate the initial formation of a paper web during the manufacture of paper. Most particularly, the present invention provides a double layer forming fabric having an upper paper carrying/forming layer which has three or more times as many cross machine direction yarns as the lower, machine side layer. p 2. Description of the Prior Art Papermaking machines transform an aqueous slurry of fibers into a continuous paper web which can be processed for a variety of end uses. Papermakers fabrics are employed throughout the papermaking process to transport the web of paper as a continuous sheet through the papermaking equipment. The papermakers fabrics also act as a drive belt for the equipment.

The paper making process starts in the forming section of a papermaking machine where the aqueous slurry is deposited onto a forming fabric having the desired characteristics for retaining the fibers while allowing the water to pass through. The wet paper web created by this process is then carried by a press fabric through the press section where additional water is removed by squeezing the paper web and fabric between two rolls. The paper web is then carried through the drying section on a dryer fabric to remove additional water through forced evaporation. The design of papermakers fabrics used on each section of a papermaking machine vary in accordance with function.

In the forming section of papermaking machines, the fibers are retained and collected on the upper surface of a forming fabric and formed into a paper sheet. The forming fabric must have a fine mesh weave on the paper contact side in order to avoid marking the paper and to support the fiber from the slurry. The fabric must also have good drainage characteristics for initial water removal to facilitate paper formation. However, as previously noted, the forming fabric also serves as a drive belt and is subjected to high tensile loads in the machine direction and compressive or buckling loads in the cross machine direction. Therefore, a single fine-mesh yarn system is not suitable for use as a forming fabric.

To combat the prior art problem, multi-layer forming fabrics were developed with fine-mesh yarns on the paper forming surface to facilitate paper formation, and larger yarns on the machine contact side to provide strength and longevity.

Multi-layer forming fabrics are known in the art. For example: U.S. Pat. No. 4,709,732 discloses a dual layer forming fabric for use in the papermaking process; U.S. Pat. No. 5,025,839 also discloses a two-ply forming fabric with zig-zagging MD yarns; and U.S. Pat. No. 4,605,585 teaches a two ply forming fabric with a two-shaft, twill or satin weave pattern.

While these fabrics perform satisfactorily in many applications, it is desirable to provide a forming fabric having a higher degree of fiber support on the paper forming side while still maintaining good drainage characteristics.

SUMMARY OF THE INVENTION

The present invention provides an improved papermakers forming fabric of a type having two layers of CMD yarns interwoven with a system of MD yarns to form a multi-layer fabric which has a paper support surface and a machine contact surface. The paper support surface CMD yarn layer has a yarn count that provides at least three times as many CMD yarns as the yarn count of the machine contact surface CMD yarn layer. The higher count of upper layer CMD yarns provides an improved paper forming/carrying surface with improved drainage characteristics.

It is an object of this invention to provide a forming fabric having a high fiber support index.

It is an object of this invention to provide a forming fabric having a high drainage index.

Additional objects and advantages of the present invention will be apparent from the detailed description which follows.

DETAILED DESCRIPTION OF THE PREFERRED EMBODIMENT

The preferred embodiment will be described with reference to the drawings wherein like numerals identify like elements. As used throughout this description, yarn counts refer to the number of yarns per standard unit of measurement.

Figure 1:
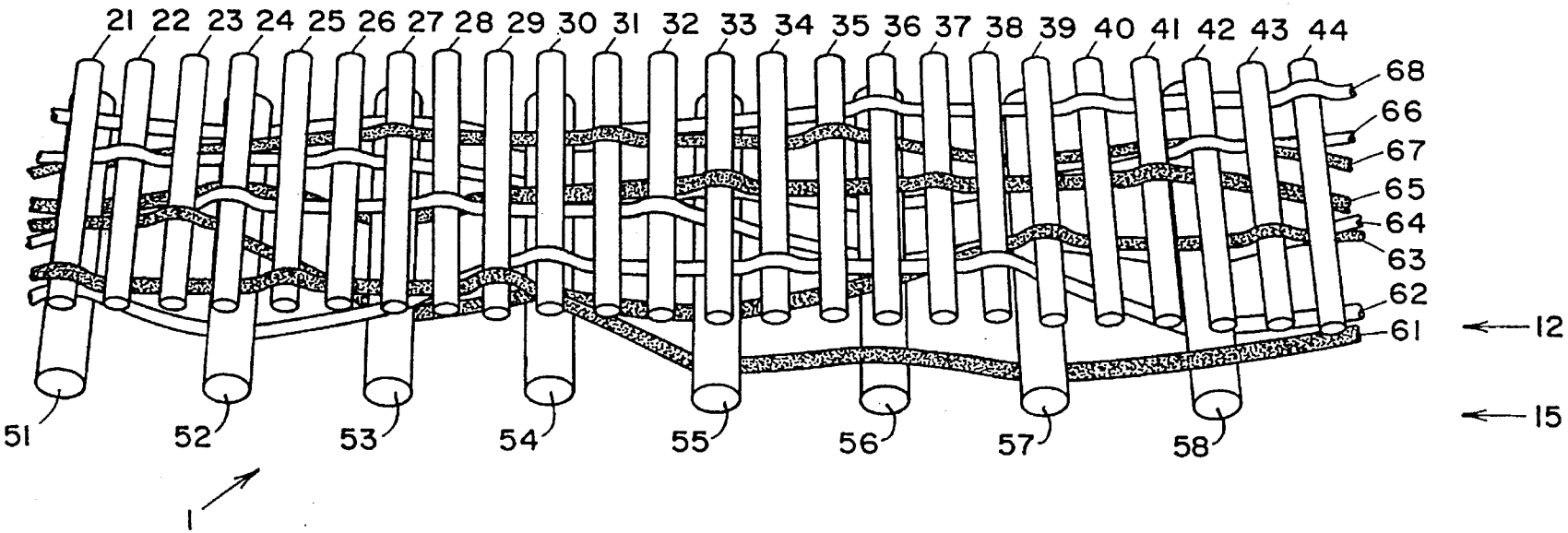
FIG. 1 is a perspective view of the forming fabric in accordance with the present invention.

Referring to FIG. 1, there is shown a portion of the fabric 1 in accordance with the present invention. The fabric 1 of the present invention is comprised of a top layer 12 of cross machine direction (CMD) yarns 21–44 and a bottom layer 15 of cross machine direction (CMD) yarns 51–58. The top and bottom CMD layers 12 and 15 are interwoven with a system of machine direction (MD) yarns 61–68 in a repeated pattern, as is known in the art.

As will be appreciated by those skilled in the art, papermakers fabrics may be woven endless or may be flat woven and then seamed to form an endless belt. In an endlessly woven fabric, the warp yarns in the loom become the cross machine direction yarns with respect to the orientation of the fabric on a papermaking machine. In a fabric which is woven flat and seamed, the warp yarns on the loom become the machine direction yarns with respect to the papermaking machine. The techniques for endlessly weaving or flat weaving and seaming a papermakers fabric are well known in the art and the fabric of the present invention can be woven endlessly or flat woven and seamed. In order to avoid confusion, the description of the fabric which follows will be made only with reference to the orientation of the fabric on a papermaking machine and the yarns will only be referred to as MD or CMD.

In the preferred embodiment, the forming fabric 1 is woven with three times as many yarns in the upper CMD layer 12 than in the lower CMD layer 15. Eight MD yarns 61–68 interweave with the twenty-four upper layer CMD yarns and eight of the larger lower layer CMD yarns per repeat.

In general, each MD yarn interweaves with the upper CMD layer yarns in a repeated pattern, transitions between the upper CMD layer 12 and the lower CMD layer 15 to interweave with the lower CMD layer yarns and then transitions back to the upper CMD layer 12 for another repeat, and so on.

Figure 2:
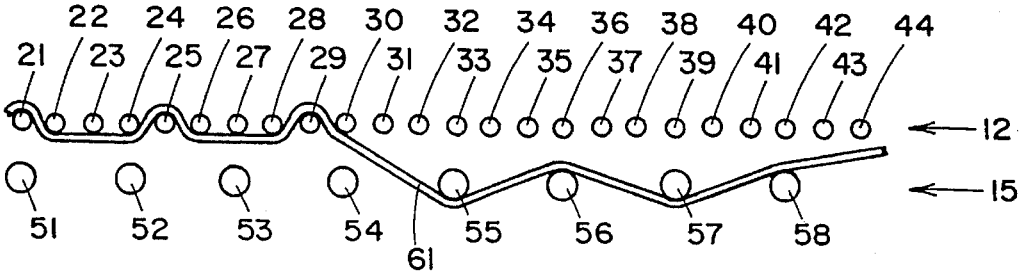
FIG. 2 is a sectional view along the machine direction depicting the weave pattern of a first MD yarn interweaving with the CMD yarn layers of the fabric.

The detailed weaving of each MD yarn of the repeat is shown in FIGS. 2 through 9. As shown in FIG. 2, MD yarn 61 weaves first with the upper CMD yarn layer 12 by passing over upper CMD yarn 21, under upper CMD yarns 22, 23 and 24, over upper CMD yarn 25, under upper CMD yarns 26, 27 and 28, over upper CMD yarn 29, and then passes between upper CMD yarn 30 and lower CMD yarn 54 in a transition to the lower CMD yarn layer 15 where it passes under lower CMD yarn 55, over lower CMD yarn 56, and under lower CMD yarn 57, before passing between lower CMD yarn 58 and upper CMD yarn 42 in transitioning back to weaving with the upper CMD yarn layer 12. The MD yarn 61 is woven in essentially a plain weave pattern with the lower CMD yarn layer 15 to bind a respective lower layer CMD yarn in an aligned position with a respective upper layer CMD yarn.

Figure 3:
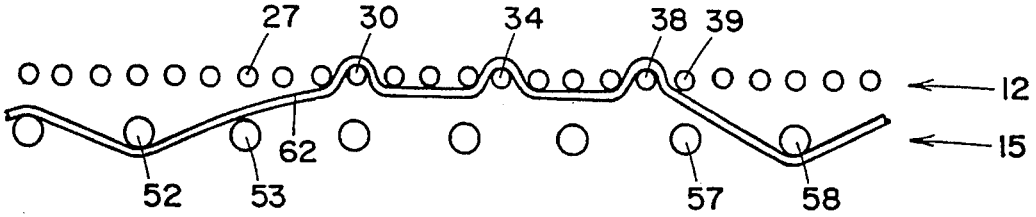
FIG. 3 is a sectional view along the machine direction depicting the weave pattern of a second MD yarn interweaving with the CMD yarn layers of the fabric.

As illustrated in FIG. 3, the MD yarn 62 has transitioned to the lower CMD layer 15 where it passes under lower CMD yarn 52 before passing between lower CMD yarn 53 and upper CMD yarn 27 as it transitions to weaving with the upper CMD layer 12, where it passes over upper CMD yarns 30, 34 and 38, prior to passing between upper CMD yarn 39 and lower CMD yarn 57, as it transitions back to weaving with the lower CMD layer 15, where it passes under lower CMD yarn 58.

Figure 4:
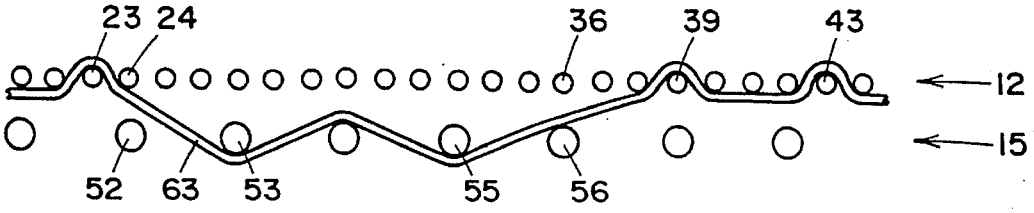
FIG. 4 is a sectional view along the machine direction depicting the weave pattern of a third MD yarn interweaving with the CMD yarn layers of the fabric.

MD yarn 63, shown in FIG. 4, passes over upper CMD yarn 23 in the upper CMD layer 12, and then passes between upper CMD yarn 24 and lower CMD yarn 52 as it transitions to weaving with the lower CMD layer 15, where it passes under lower CMD yarns 53 and 55, before passing between lower CMD yarn 56 and upper CMD yarn 36 in transitioning back to weaving with the upper CMD layer 12, where it passes over upper CMD yarns 39 and 43.

Figure 5:
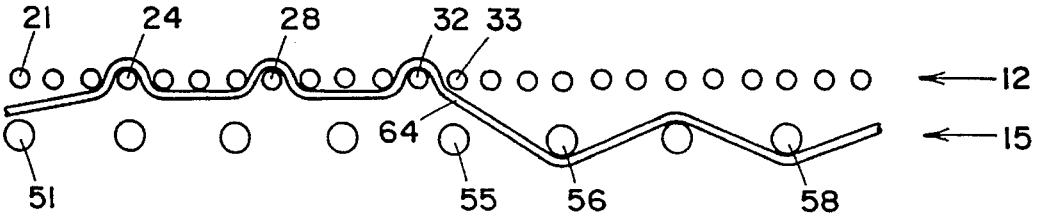
FIG. 5 is a sectional view along the machine direction depicting the weave pattern of a fourth MD yarn interweaving with the CMD yarn layers of the fabric.

MD yarn 64, as shown in FIG. 5, passes between lower CMD yarn 51 and upper CMD yarn 21, as it transitions from the lower CMD layer 15 to interweave with the upper CMD layer 12, where it passes over upper CMD yarns 24, 28 and 32, and then passes between upper CMD yarn 33 and lower CMD yarn 55, as it transitions back to weaving with the lower CMD layer 15, where it passes under lower CMD yarns 56 and 58.

Figure 6:
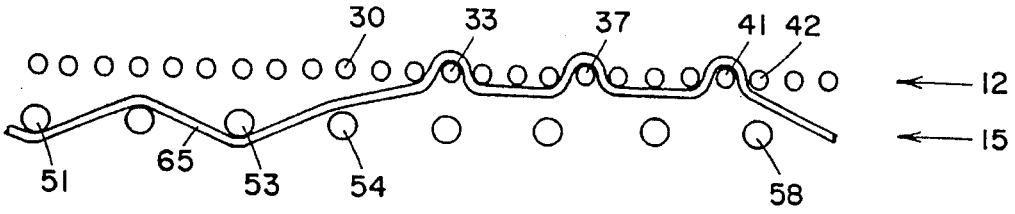
FIG. 6 is a sectional view along the machine direction depicting the weave pattern of a fifth MD yarn interweaving with the CMD yarn layers of the fabric.

MD yarn 65, as shown in FIG. 6, has transitioned to the lower CMD layer 15 where it passes under lower CMD yarns 51 and 53, and then passes between lower CMD yarn 54 and upper CMD yarn 30 as it transitions to weaving with the upper CMD layer 12, where it passes over upper CMD yarns 33, 37 and 41, prior to passing between upper CMD yarn 42 and lower CMD yarn 58 as it transitions back to weaving with the lower CMD layer 15.

Figure 7:
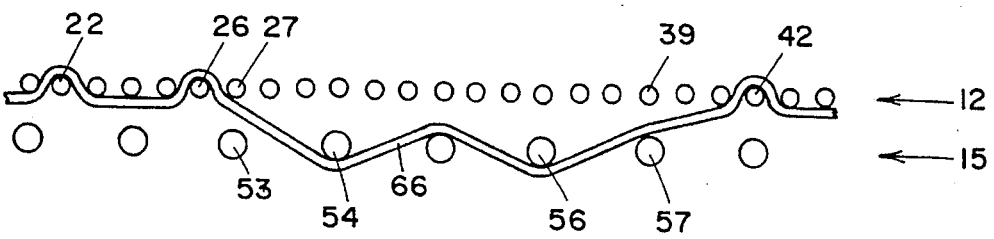
FIG. 7 is a sectional view along the machine direction depicting the weave pattern of a sixth MD yarn interweaving with the CMD yarn layers of the fabric.

MD yarn 66, as shown in FIG. 7, passes over upper CMD yarns 22 and 26 in upper CMD layer 12, and then passes between upper CMD yarn 27 and lower CMD yarn 53 as it transitions to weaving with the lower CMD layer 15, where it passes under lower CMD yarns 54 and 56, prior to passing between lower CMD yarn 57 and upper CMD yarn 39 as it transitions back to weaving with the upper CMD layer 12, where it passes over upper CMD yarn 42.

Figure 8:
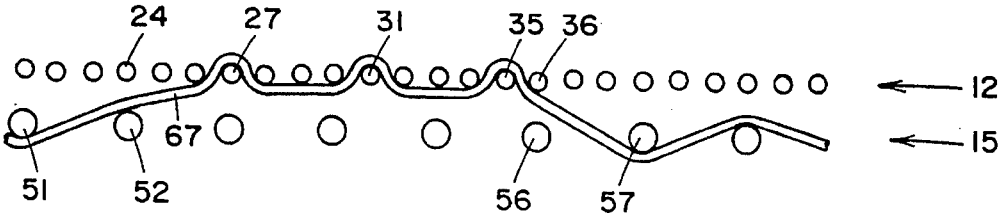
FIG. 8 is a sectional view along the machine direction depicting the weave pattern of a seventh MD yarn interweaving with the CMD yarn layers of the fabric.

MD yarn 67, as shown in FIG. 8, has transitioned to the lower CMD layer 15 where it passes under lower CMD yarn 51, before passing between lower CMD yarn 52 and upper CMD yarn 24 as it transitions to weaving with the upper CMD layer 12, where it passes over upper CMD yarns 27, 31 and 35, prior to passing between upper CMD yarn 36 and lower CMD yarn 56, as it transitions back to weaving with the lower CMD layer 15 where it passes under lower CMD yarn 57.

Figure 9:
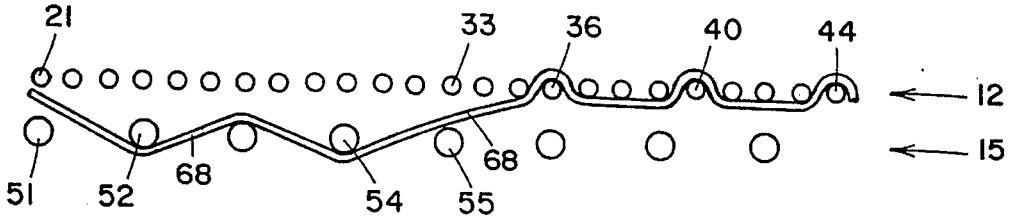
FIG. 9 is a sectional view along the machine direction depicting the weave pattern of a eighth MD yarn Interweaving with the CMD yarn layers of the fabric.

MD yarn 68, as shown in FIG. 9, passes between upper CMD yarn 21 and lower CMD yarn 51 as it transitions from weaving with the upper CMD layer 12 to the lower CMD layer 15, where it passes under lower CMD yarns 52 and 54, prior to passing between lower CMD yarn 55 and upper CMD yarn 33, as it transitions back to weaving with the upper CMD layer 12, where it passes over upper CMD yarns 36, 40 and 44.

Figure 10:
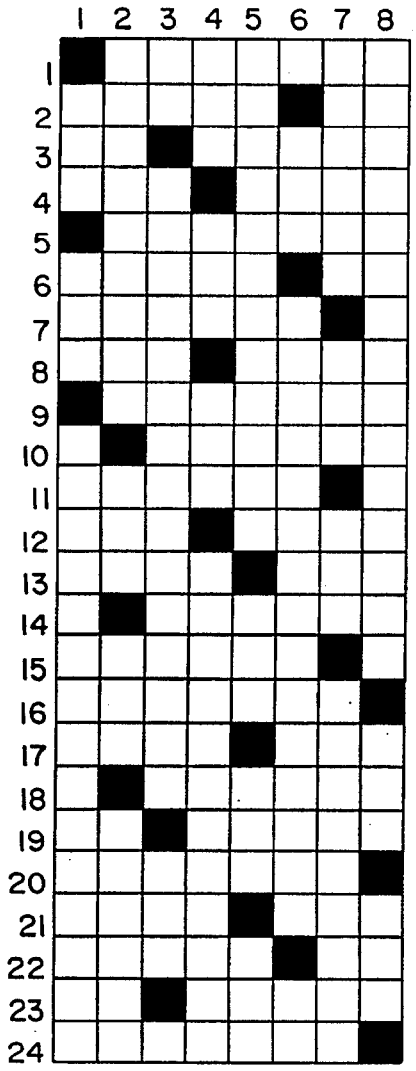
FIG. 10 is a weave pattern diagram showing the face pattern for the upper paper carrying/forming layer of the forming fabric of the present invention.
Figure 11:
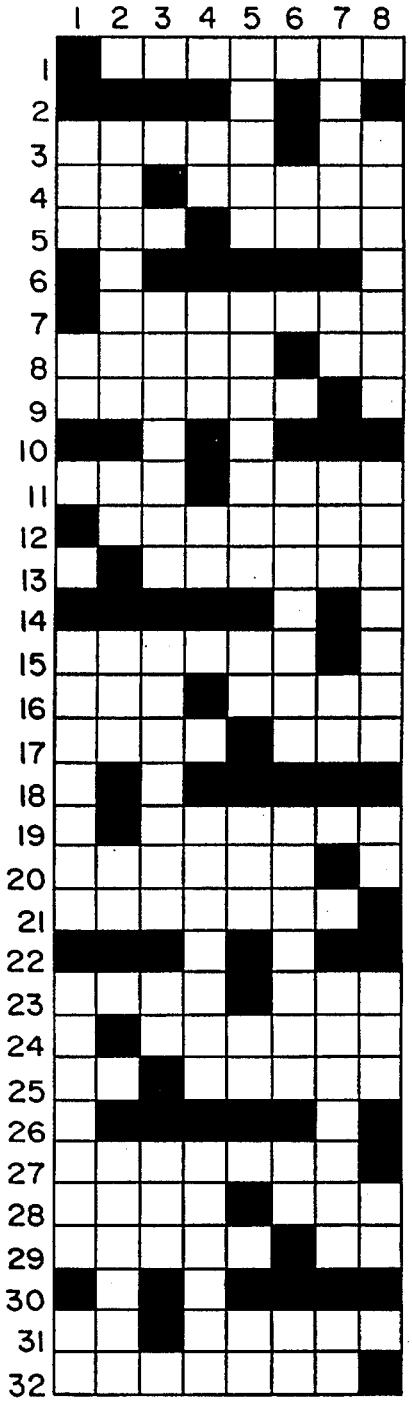
FIG. 11 is a weave pattern diagram for the forming fabric of the present invention.

FIG. 10 is a weave pattern diagram for the upper surface weave pattern. The filled-in boxes indicate where the MD yarns cross over the respective CMD yarns. As shown in FIG. 10, each upper CMD yarn 21–44 in a given repeat is only under a single MD yarn 61–68. This provides a paper support side of the fabric which is dominated by CMD yarns that extend over seven MD yarns.

The top layer CMD yarns are preferably polyester monofilaments having a diameter of 0.0045 inches. The bottom layer CMD yarns are preferably polyester monofilaments having a diameter of 0.0070 inches. Preferably, the MD yarns are also polyester monofilaments approximately 0.0045 inches in diameter. After weaving, the fabric is generally heat set, in a known manner, to finish the fabric. In the preferred embodiment, the fabric as woven and finished has a yarn count of 200–210 MD yarns per inch and 160–170 CMD yarns per inch with the ideal fabric having 210 MD yarns per inch and 165 CMD yarns per inch.

Although specific yarn sizes for the fabric of the preferred embodiment have been disclosed, the diameter of the top layer CMD yarns can range from 0.0032 to 0.0300 inches, and the diameter of the bottom layer CMD yarns can range from 0.0035–0.0450 inches. The diameter of the MD yarns can range from 0.0032–0.0250 inches. Preferably, the yarn diameter of the top layer CMD yarns is approximately 50%–90% of that for the bottom layer CMD yarns. AS the yarn sizes are varied within the noted ranges, the yarn count per inch will vary accordingly.

The physical properties of the fabric of the present invention were compared with a two layer forming fabric having equal numbers of upper and lower CMD yarns and a forming fabric having twice as many upper CMD layer yarns as lower CMD layer yarns. A summary of the test data is provided in Table 1 below:

TABLE 1

| | Comparison of Physical Properties | | |
|---|---|---|---|
| | Two Layer 1/1 CMD Ratio | Two Layer Extra 2/1 CMD Ratio | Present Invention 3/1 CMD Ratio |
| Weave | 8 shed | 8 shed | 8 shed |
| Mesh (MD × CMD) | 195 × 170 | 200 × 150 | 208 × 166 |
| Air Perm (cfm) | 470 | 570 | 485 |
| Caliper | 0.0184" | 0.022" | 0.0236" |
| Modulus (pli) | 3,300 | 3,500 | 4,340 |
| FSI | 145.8 | 158.4 | 200.7 |

The Fiber Support Index (FSI) was calculated in accordance with the formula of R.L. Beran, as published in Vol. 62, No. 4 issue of the TAPPI Journal, April 1979.

As can be seen from the data, the present invention has a comparable air permeability and modulus in relation to the other fabrics but has a higher FSI value. The higher FSI indicates that the fabric of the present invention provides improved sheet formation and sheet quality. The improved sheet formation results from the present fabric's ability to trap more fines from the slurry while still allowing good water drainage through the fabric. Additionally, the present fabric allows the use of a lesser amount of fiber in the slurry. Since there are fewer bottom layer CMD yarns in comparison to the top layer CMD yarns, this fabric is easier to clean with the showers used on the papermaking machine to remove fibers which become lodged in the interstices of the fabric.

By way of comparison, the 1/1 fabric would need a CMD yarn count of 252 yarns per inch to achieve the same FSI. This would require the use of such fine diameter CMD yarns that the fabric would be unstable, or with larger diameter yarns the fabric would be unusable due to poor permeability.

Although the presently preferred embodiment of the invention has an upper CMD layer which contains three times as many yarns as the lower CMD layer, it is within the scope of the present invention to provide a forming fabric having four or more times as many upper CMD layer yarns as lower CMD layer yarns. The description for a fabric having four times as many upper layer CMD yarns than in the lower layer follows.

Figure 12:
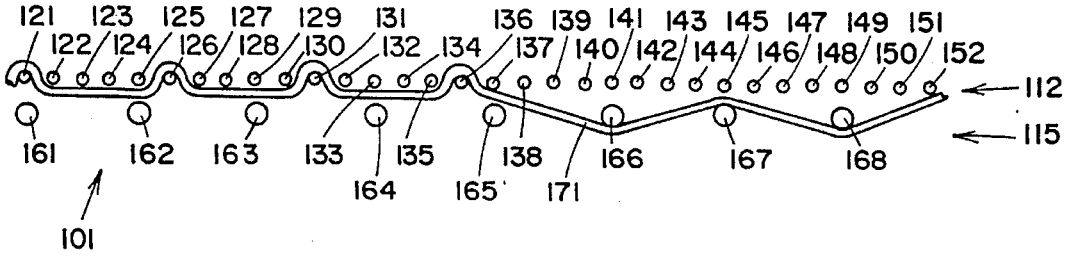
FIG. 12 is a sectional view along the machine direction of a second embodiment of the fabric of the present invention depicting the weave pattern of a first MD yarn interweaving with the CMD yarn layers.
Figure 13:
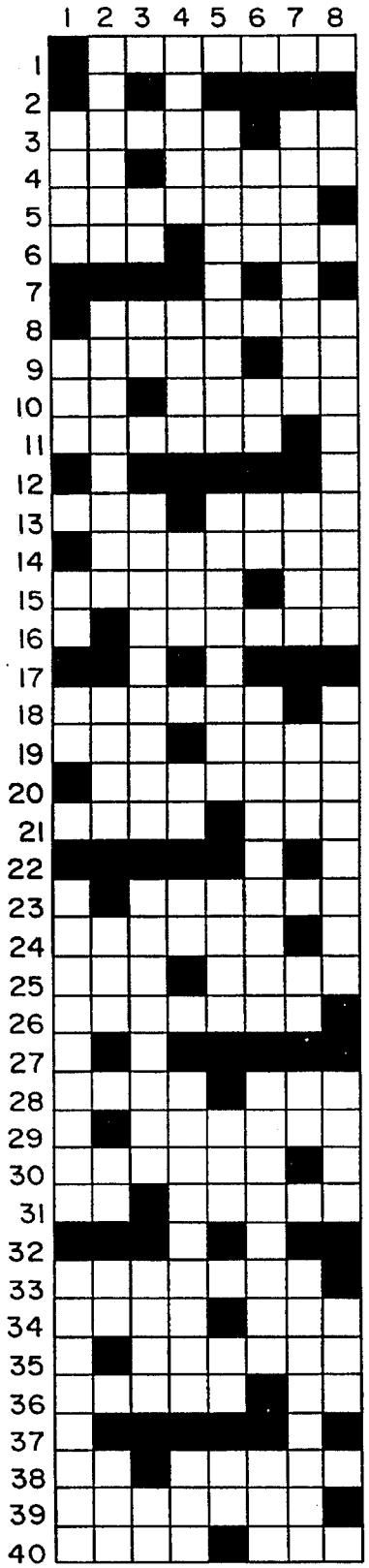
FIG. 13 is a weave pattern diagram for the second embodiment of the forming fabric in accordance with the present invention.

Referring now to FIG. 12, a sectional view taken along the machine direction of a second embodiment of the forming fabric 101 in accordance with the present invention is shown. FIG. 13 provides the weave pattern diagram for the fabric 101. The fabric 101 is comprised of an upper layer of CMD yarns 112 and a lower layer of CMD yarns 115 interwoven with a system of MD yarns in an 8 -shed repeat pattern. A single MD yarn 171 is shown in the repeat of FIG. 12.

The fabric 101 is woven with four times as many yarns in the upper CMD layer 112 as compared to the lower CMD layer 115. Eight MD yarns interweave with thirty-two upper layer CMD yarns 121–152 and eight lower layer CMD yarns 161–168.

As illustrated in FIGS. 12 and 13, each of the upper CMD yarns, 121 through 152, is only under a single MD yarn in a given repeat, and the upper CMD yarns float over seven MD yarns. The weave repeat is similar to that of the prior embodiment in the upper CMD layer and is the same in the lower CMD layer.

Other variations within the scope and spirit of the invention will be apparent to those of ordinary skill in the art.

I claim:

1. A papermakers fabric comprising two layers of CMD yarns interwoven with a system of MD yarns to form a multi-layer fabric having a paper support surface and a machine contact surface wherein the paper support surface CMD yarn layer has at least three times as many yarns as the number of yarns in the machine contact surface CMD yarn layer and all of the MD yarns weave with both CMD yarn layers.

2. A woven papermakers fabric having cross machine direction (CMD) and machine direction (MD) yarns comprising:

a lower CMD yarn layer having a selected number of yarns per inch;

an upper CMD yarn layer having at least three times said selected number of yarns per inch;

said upper layer CMD yarns being of a smaller diameter than said lower layer CMD yarns;

a system of MD yarns interwoven with said CMD yarn layers in a repeat pattern to bind the CMD yarns in position; and all of the MD yarns are interwoven with both said upper and lower CMD yarn layers.

3. The fabric of claim 2 wherein said repeat pattern comprises eight lower CMD yarns and twenty-four upper CMD yarns interwoven with eight MD yarns.

4. The fabric of claim 2 wherein each MD yarn passes over three non-adjacent upper layer CMD yarns that are separated from each other by at least three adjacent upper layer CMD yarns, and under two non-adjacent lower CMD yarns within a given repeat.

5. The fabric of claim 2 wherein said repeat pattern comprises eight lower CMD yarns and thirty-two upper CMD yarns interwoven with eight MD yarns.

* * * * *